United States Patent [19]

Cole et al.

[11] 4,084,335

[45] Apr. 18, 1978

[54] BOWL AND EJECTOR APPARATUS

[75] Inventors: Carroll R. Cole; Robert L. Christian, both of Decatur, Ill.

[73] Assignee: Caterpillar Tractor Co., Peoria, Ill.

[21] Appl. No.: 788,853

[22] Filed: Apr. 19, 1977

[51] Int. Cl.[2] ..... E02F 3/85

[52] U.S. Cl. ..... 37/126 AE; 37/129

[58] Field of Search ..... 37/126 AE, 124 R, 126 R, 37/126 AC, 126 AD, 126 AA, 126 AB, 129, 8; 214/82

[56] References Cited

U.S. PATENT DOCUMENTS

| | | | |
|---|---|---|---|
| 2,674,815 | 4/1954 | Adams | 37/129 |
| 2,677,202 | 5/1954 | Gustafson | 37/129 |
| 3,100,945 | 8/1963 | Bernotas | 37/129 |
| 3,308,565 | 3/1967 | Walters et al. | 37/129 |
| 3,418,735 | 12/1968 | Martin | 37/129 |
| 3,427,735 | 2/1969 | Martin | 37/129 |
| 3,430,367 | 3/1969 | Rockwell et al. | 37/129 |
| 3,462,859 | 8/1969 | Hawk | 37/129 |
| 3,563,328 | 2/1971 | Ahola et al. | 180/56 |
| 3,890,726 | 6/1975 | Girard et al. | 37/124 |

*Primary Examiner*—E.H. Eickholt
*Attorney, Agent, or Firm*—Frank L. Hart

[57] ABSTRACT

A scraper has a frame with first and second spaced apart side elements, a bowl, and an ejector system. The ejector system is connected to the bowl and is movable, relative to the bowl, for receiving or removing material into and from the bowl.

The ejector system has first and second motors, each connected to opposite sides of the frame at locations outwardly of the first and second side elements. A power means is connected to and positioned between the first and second frame side elements.

6 Claims, 3 Drawing Figures

BOWL AND EJECTOR APPARATUS

BACKGROUND OF THE INVENTION

In the load carrying modes of heavy earthmoving vehicles, a scraper experiences a stabiliaty condition typical of high center-of-gravity performance, especially at higher vehicle speeds and while traversing uneven terrain. A major contributing factor is the high position of the heavy power source and ejector system construction.

Undesirable damage was sometimes subjected on the bowl floor due to a combination of heavy bowl loads and thrust contact with irregularities in uneven terrain. The low flat floor construction prohibited the placement of reinforcing braces between the floor and rear transverse support members.

In some cases, where it was necessary to replace bowl liners, there was no means for adjusting the ejector blade to the replacement liners. The roller and guide system also added to the difficulty and expense of installing liner material.

The present invention is directed to overcoming one or more of the problems set forth above.

According to the present invention, a scraper has a frame with first and second spaced apart side elements, a bowl, and an ejector system. The ejector system is connected to the bowl and is movable relative to the bowl.

An ejector system has first and second motors each connected to opposite sides of the frame at locations outwardly of the first and second side elements. A power means is connected to and positioned between the first and second frame side elements.

DETAILED DESCRIPTION OF THE INVENTION

Figure 1:
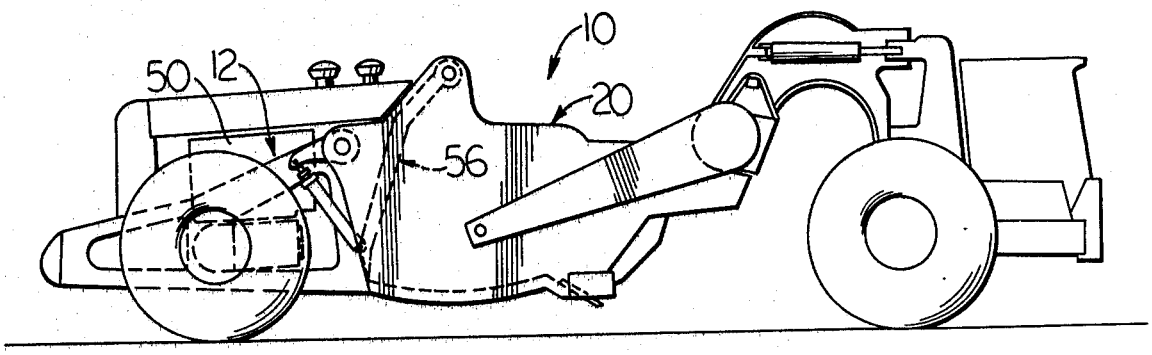
FIG. 1 is a diagrammatic side view of a low-profile scraper showing the environment of the bowl and ejector apparatus.
Figure 2:
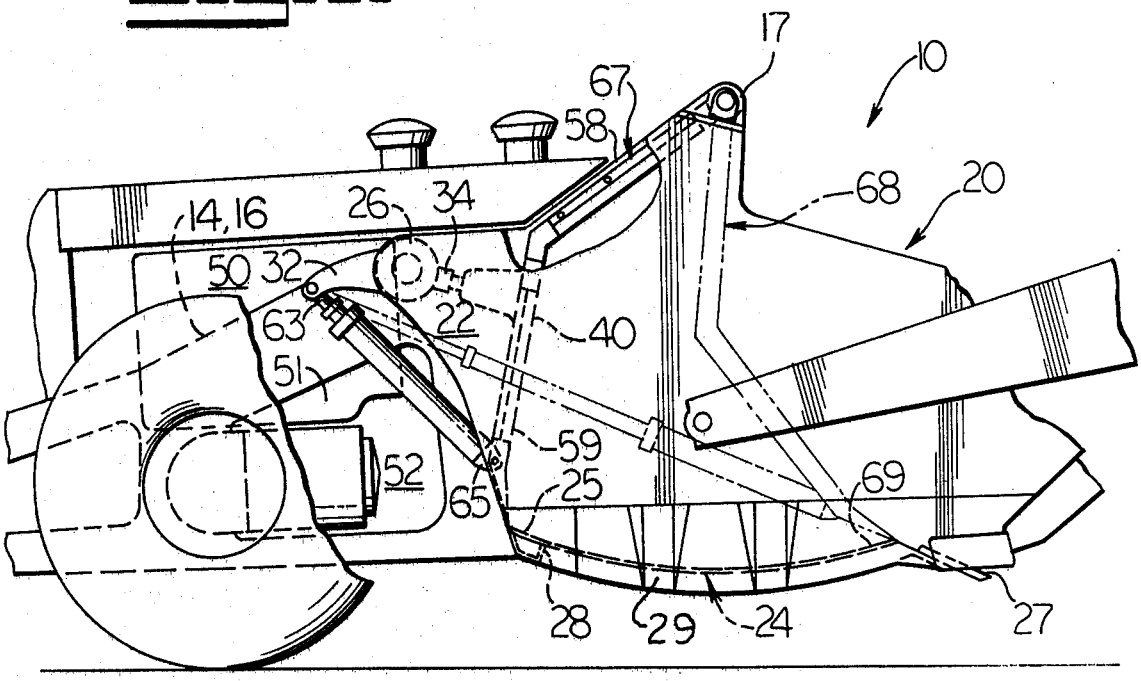
FIG. 2 is a diagrammatic side view of a portion of a scraper showing a bowl and ejector apparatus with portions broken away.

Referring to FIGS. 1 and 2, a rear-powered scraper 10 has a frame 12 with first and second spaced apart side elements 14, 16, a bowl 20, a power means 50, and an ejector system 56.

The ejector system 56 is connected to the bowl 20 and is movable relative thereto for receiving and removing material, such as dirt for example, into and from the bowl 20.

Figure 3:
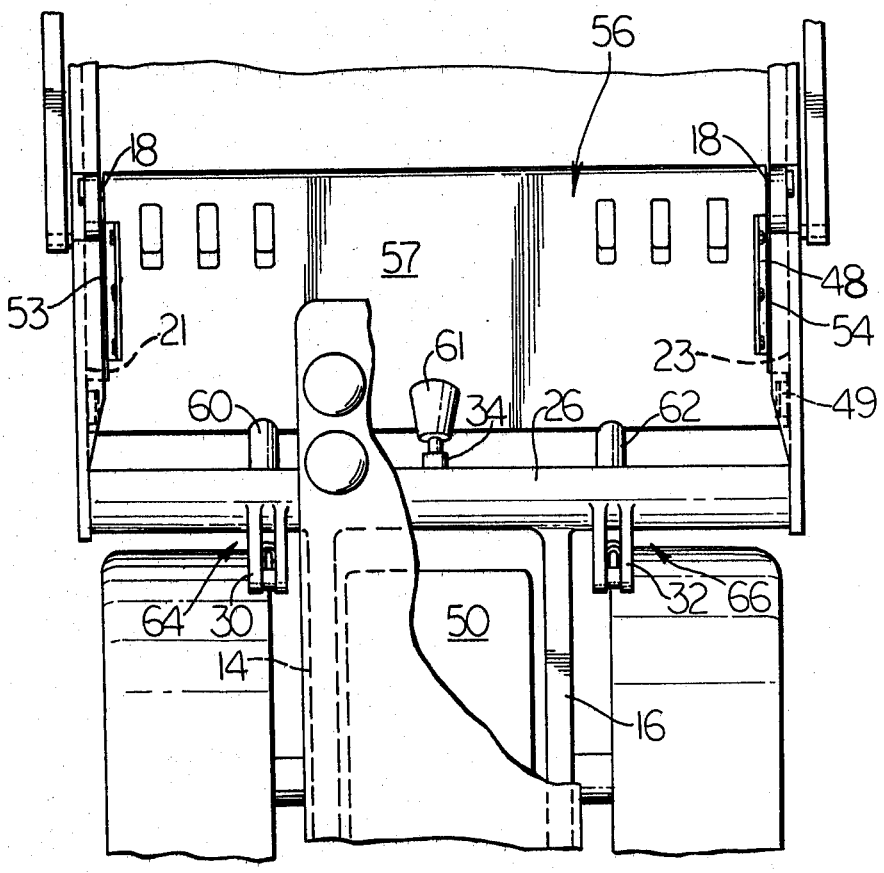
FIG. 3 is a diagrammatic top view of a portion of a scraper showing a bowl and ejector apparatus with portions broken away.

Referring to FIGS. 2 and 3, the ejector system 56 has first and second motors 60, 62 connected to respective opposed sides 64, 66 of the frame 12 at specific, preselected locations outwardly of the side elements 14, 16. The power means 50 is specifically connected to and positioned between the first and second side elements 14 and 16.

The bowl 20 has a back portion 22 and a floor member 24. The frame 12 has transverse members 26 and 28 which extend across and are connected to the front of the first end side elements 14 and 16, and to the back portion 22 of the bowl 20.

The transverse member 26 has first and second flanges 30, 32, which extend rearwardly and a third flange 34 which extends forwardly. The transverse member 28 supports a back portion 25 of the floor member 24.

A lower surface 51 of power means 50 is adjacent a lower portion 52 of the first and second side elements 14, 16 to provide a low center-of-gravity for the rear-powered scraper 10.

The ejector system 56 includes an ejector blade 57 which has an upper portion 58, a lower portion 59, and a stop element 61. The ejector blade 57 extends across the bowl 20 and is pivotally connected at location 18 adjacent the bowl top 17 and is movable between a first position 67 at which the ejector blade 57 is positioned adjacent a back portion 25 of the floor member 24, and a second position 68 at which the blade 57 is positioned adjacent a forward position 69 of the floor member 24. Actuation of the ejector blade 57 from the first position 67 to the second position 68 and back, controls the exit and entry of materials through the front opening of the bowl 20.

The ejector blade 57 has a first and second outer end surface 53, 54 each having a stepped configuration. The outer end surfaces 53 and 54 each have adjustable surface elements 48 and 49 provide an adjustable, predetermined relationship between elements 48, 49 and respective bowl sides 21, 23.

The ejector blade stop element 61 is constructed for and positioned at a location sufficient for abutting the third flange 34 of the transverse member 26 when the ejector blade 57 is in the first position 67. Abutment of stop element 61 against third flange 34 in the first position 67 provides a positive, cushioned stop for the ejector blade 57 and prevents damage to adjacent rearward scraper components. A forward surface of the ejector blade 57 is oriented downwardly and forwardly at the first position 67 of the ejector blade 57 for discouraging residues of material after a load is ejected.

The floor member 24 of the bowl 20 is of a curvilinear configuration and positioned at a location relative to the pivotal location 18 of the ejector blade 57 for being immediately adjacent the blade's lower portion 59 during the blade's pivotal movement. The curvilinear construction provides strength to the bowl 20.

The motors 60 and 62 each have first and second end portions 63, 65. Each motor 60, 62 is connected at the first end portion 63 to a respective flange 30 and 32, and at the second end portion 65 to the lower portion 59 of the ejector blade 57. The motors 60 and 62 can be, for example, electrically driven motors or preferably fluid driven cylinders.

In the operation of the apparatus of this invention, a rear-powered scraper 10 can be placed in a forward drive mode while the bowl 20 is lowered to a ground engaging position and the ejector blade 57 is controllably moved from the first position 67 towards the second position 68. While the bowl 20 fills, the motors 60, 62 are controllably retracted until the ejector blade 57 abuts the frame 12. The bowl 20 can then be filled to a heaped condition.

While loaded in this manner, the curvilinear floor member 24, the transverse member 28, the cutting edge 27 and bowl braces 29 support the capacity loads and resist thrust impacts from obstacles on uneven terrain. When the scraper 10 is loaded to capacity and proceeds to the unloading site at speeds of up to 35 mph, it is assured of great stability and performance owing to the lowered position of the power source 51 within the frame 12 and the absence of high gravity, ejector actuating components.

When the unloading site is reached, the operator can controllably extend the motors 60, 62 which forces the ejector blade 57 away from its abutment at the frame 12 and forwardly through the bowl to the ejector second position 68.

By so constructing the rear-powered scraper 10, a stronger, lighter vehicle is provided which is capable of maximum performance under unusually difficult operating conditions.

The embodiments of the invention in which an exclusive property or privilege is claimed are defined as follows:

1. In a scraper having a frame with first and second spaced apart side elements, a bowl having sidewalls and a floor member with curvilinear surface, a lower transverse member extending across and supporting a back portion of the bowl floor member, an upper transverse member extending across and being fixedly connected at a middle portion to the front of said first and second frame side elements and at end portions to respective bowl sidewalls, the improvement comprising:

an ejector system including a blade connected above the top of the bowl and being pivotally movable relative thereto for receiving and removing material into and from the bowl, first and second motors, each being connected to the upper transverse member at locations outwardly of said first and second spaced apart side elements, and a power means connected to and positioned between said first and second side elements at a location below said upper transverse member.

2. A scraper, as set forth in claim 1, wherein the upper transverse members has at least two rearwardly extending and at least one forwardly extending flanges.

3. A scraper, as set forth in claim 1, wherein the blade has at least one stop element on a rearward side, said stop element being of a construction and positioned at a location sufficient for abutting the forward extending flange of said upper transverse member.

4. a scraper, as set forth in claim 1 including first and second motors each having first and second portions and being pivotally connected at the first end portion to a respective rearwardly extending flange of the upper transverse member and at the second end portion to a lower portion of the ejector blade.

5. The scraper, as set forth in claim 1, wherein the ejector blade has first and second outer surfaces of a stepped configuration.

6. The scraper, as set forth in claim 1 wherein the ejector blade has adjustable surfaces on the first and second outer end surfaces.

* * * * *